US005634827A

United States Patent [19]

Francois et al.

[11] Patent Number: 5,634,827

[45] Date of Patent: Jun. 3, 1997

[54] ELECTRICAL CONNECTION DEVICE FOR CONDUCTING CABLE SHIELDS AND METHODS OF EMPLOYING IT

[75] Inventors: Pierre Francois, Limoges; Eric Sauër, Vrigne-aux-Bois, both of France

[73] Assignee: Societe Industrielle de Construction d'Appareils et de Materiel Electriques - Societe Anonyme, Arnac Pompadour, France

[21] Appl. No.: 386,869

[22] Filed: Feb. 10, 1995

[30] Foreign Application Priority Data

Feb. 24, 1994 [FR] France ..... 94 02359

[51] Int. Cl.[6] ..... H01R 4/38

[52] U.S. Cl. ..... 439/799; 439/800

[58] Field of Search ..... 439/799, 800, 439/98, 100

[56] References Cited

U.S. PATENT DOCUMENTS 2,913,699 11/1959 Cushenberry ..... 439/799 OR 4,623,204 11/1986 Auclair ..... 439/100 OR 4,875,864 10/1989 Campbell ..... 439/100 OR

FOREIGN PATENT DOCUMENTS 0876348 8/1961 United Kingdom ..... 439/800 OR

*Primary Examiner*—David L. Pirlot

*Assistant Examiner*—Daniel Wittels

*Attorney, Agent, or Firm*—Oliff & Berridge

[57] ABSTRACT

The device applies to conducting cables with a metal protective shield of small thickness, inserted between the conductor or conductors of the cable and an insulating outer jacket. The device, providing, for example, the grounding of the shield, includes a connector having a rigid body capable of bearing on the periphery of the cable, and a flexible filiform conducting element provided for encircling the cable, the latter being positioned in a transverse groove progressively hollowed out, by mechanical and/or thermal effect, with the aid of a cord or other filiform flexible member, in the insulating outer jacket over at least a fraction of its circumference and reaching the shield. A mechanism is provided on the connector for immobilizing, and mechanically tensioning in a controlled manner, that part of the flexible conducting element encircling the cable.

16 Claims, 7 Drawing Sheets

ELECTRICAL CONNECTION DEVICE FOR CONDUCTING CABLE SHIELDS AND METHODS OF EMPLOYING IT

BACKGROUND OF THE INVENTION

The present invention relates to an electrical connection device for conducting cable shields, in particular those of telecommunication cables. This invention applies more particularly to cables provided with a protective shield of very small thickness, consisting of a metal layer, especially an aluminum layer, covered with an insulating protective layer, such as one made of polyethylene. Such a shield, together with its connection device, makes it possible to protect the cable which it surrounds from radiofrequency electromagnetic interference and to provide grounding or connection to a chassis, for example by connecting a cable, forming part of an installation, to a structure receiving this installation, or to provide continuity between two shields.

DESCRIPTION OF THE RELATED ART

More particularly, constructions are known with a protective shield made of aluminum having a thickness of between 80 and 200 microns, covered with a protective film made of polyethylene having a thickness of a few microns, held by adhesion (plastic coating of the aluminum). The shield thus constituted is inserted between the bundle of electrical conductors of the cable and an insulating outer jacket, positioning of this shield and of the outer jacket being achievable using extrusion.

Regarding this kind of construction, of cables with a protective shield, difficulties are currently encountered in making a reliable electrical connection to the shield, for the purpose of grounding or of taking up the potential or the continuity of this shield. These difficulties of making a connection stem from the adhesion of the shield to the outer jacket and from the small thickness of the shield. The connection is usually made on site, at one end of the cable, and it consists in cutting out, more or less conveniently, a window in the outer jacket and then putting into place a clasp for bonding to another cable in order to provide electrical continuity of the shield or to around it. When cutting out the window and putting the bonding clamp into place, there is a risk of damaging the shield and/or damaging the conductors of the cable.

The invention aims to avoid these drawbacks, by providing a device enabling a connection to be made to the shield at any point along the cable, on a small part of the periphery of it, simply, quickly, and without the risk of damaging the shield or the conductors forming part of the cable.

SUMMARY OF THE INVENTION

For this purpose, the subject of the invention essentially is an electrical connection device for conducting cable shields of the kind in question, the device comprising a connector having a rigid body capable of bearing on a region of the periphery of the cable, and a flexible filiform conducting element provided for encircling the cable being positioned in a transverse groove, hollowed out in the insulating outer jacket of the cable over at least a fraction of its circumference, and reaching the shield, means being provided for securing an end of the flexible filiform conducting element to the body of the connector and for immobilizing, with controlled mechanical tensioning, of the part of this flexible filiform conducting element encircling the cable.

The flexible filiform conducting element, coming into contact with the protective shield of the cable, may take the from of a conducting braid or a "flexible cablette" or a strip. This flexible conducting element forms a loop which is received in a groove hollowed out in the thickness of the insulating outer jacket of the cable and preferably covering an arc less than a complete circumference, while the rigid body of the connector bears on that part of the insulating outer jacket remaining intact.

According to a preferred embodiment of the connection device forming the subject of the invention, one end of the flexible filiform conducting element is secured to the body of the connector by means of threaded controlled-mechanical-tensioning member through which the connected end passes axially, the body of the connector including a recess, such as a channel or notch, receiving the strand of the flexible filiform conducting element forming the end of the loop encircling the cable, a lock screw being provided for immobilizing this strand of the flexible filiform conducting element in the recess.

In an advantageous embodiment, the threaded controlled-mechanical-tensioning member is an internally threaded bush mounted so as to rotate, but axially immobilized on the body of the connector, while the end of the flexible conducting element is provided with an externally threaded driver interacting with the internal thread of the bush.

Advantageously, the mechanical-tensioning screw and the lock screw are shear-head screws permitting easy control of their tightening torque, and therefore control of the tension in the flexible filiform conducting element encircling the cable and of its contact force on the shield, and therefore optimum contact between this flexible filiform conducting element and the shield forming part of the cable.

According to a particular embodiment, the connector is provided with a conducting braid, one end of which is fastened to the body of the connector and designed to provide the envisaged electrical bonding: grounding of the shield of the cable, continuity, potential equalization, outflow of electromagnetic interference currents. In this case, the free strand of the flexible filiform conducting element may be cut as close as possible to the body of the connector, after immobilizing and tensioning the flexible filiform conducting element around the cable.

According to another possibility, dispensing with the aforementioned braid, the free strand of the flexible filiform conducting element, not cut, is used to provide directly the envisaged electrical bonding, such as grounding the shield of the cable.

For this purpose, depending on the case, the free end of the bonding braid or the free end of the flexible filiform conducting clement is advantageously equipped with a lug, to be crimped or fixed by any other means, such as screwing, for example to a ground plane.

In its final state, the connection device forming the subject of the invention may furthermore comprise sealing and insulating means surrounding the connector as well as the cable.

The subject of the invention is also a method of making an electrical connection for conducting cable shields of the kind in question, employing the connection device defined hereinabove.

This method essentially consists in:

hollowing out, in the insulating outer jacket of the cable, over at least a fraction of its circumference, a groove whose bottom reaches the shield;

engaging the flexible filiform conducting element of the aforementioned device in the groove, forming a loop, while the body of the connector is applied on a region of the periphery of the cable:

immobilizing and mechanically tensioning, in a controlled manner, the flexible conducting element; and making the envisaged electrical bonding between the connector and an external element.

Preferably, the groove is made over a fraction of the complete circumference of the cable, for example in a circular arc of approximately 300°, so as to leave part of the outer jacket intact, on which part the body of the connector is applied.

According to one mode of implementing the method, the groove is hollowed out in the insulating outer jacket of the cable by using a filiform flexible element of the cord kind, surrounding the cable and subjected to a to-and-fro movement. The groove is thus easily formed, at the desired point on the cable, by a mechanical abrasion effect or by a thermal effect (local melting of the insulating jacket of the cable), or else by the combination of these two effects. The operator, giving the cord a to-and-fro movement, preferably by virtue of gripping means such as handles equipping both ends of the cord, easily sees when this cord makes contact with the shield; the to-and-fro movement may even be continued on the shield without limit, since the risk of damaging the shield is, in this ease, virtually nil, whatever the nature of the shield. Once the cord has been removed, the groove formed in the insulating jacket can immediately receive the flexible filiform conducting element of the connector, then brought up to the cable. It will be noted that the positioning of the connector does not require engaging the conducting element around the cable via one end of it. Quite the contrary, the connector can be installed on a cable without access to the ends, the flexible filiform conducting element being wrapped, with one turn, around the cable, before being brought back and locked onto the body of the connector.

BRIEF DESCRIPTION OF THE DRAWINGS

In any event, the invention will be better understood with the aid of the following description, with reference to the appended diagrammatic drawings depicting, by way of examples, three embodiments of this electrical connection device for conducting cable shields, and illustrating the method for employing this device.

DESCRIPTION OF THE PREFERRED EMBODIMENTS

Figure 2:
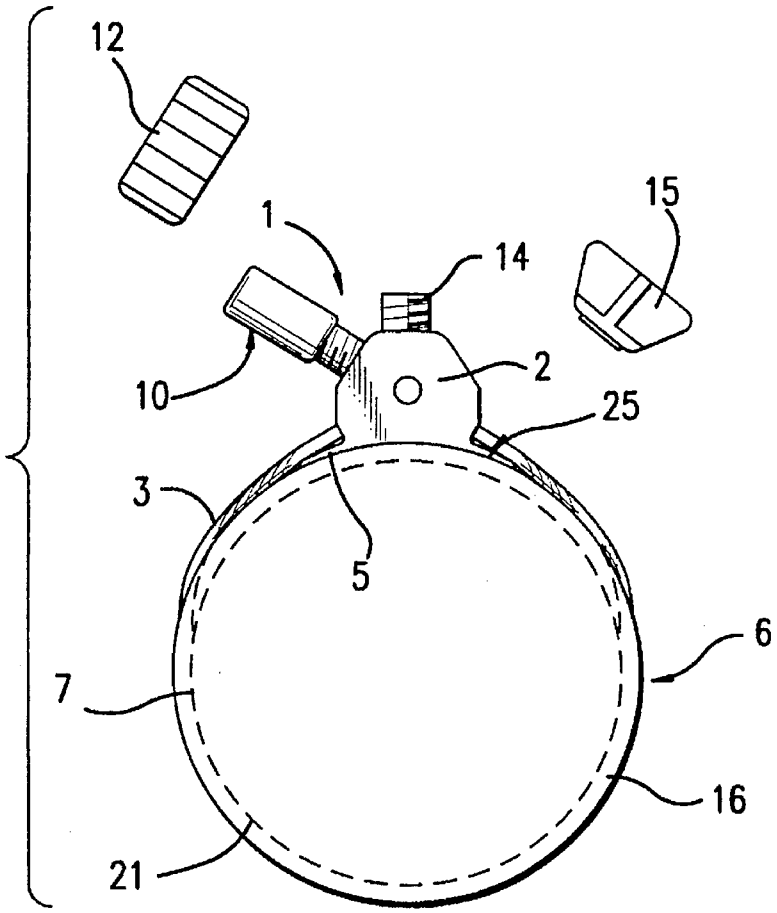
FIG. 2 is a front view of the device of FIG. 1, installed around a cable.
Figure 1:
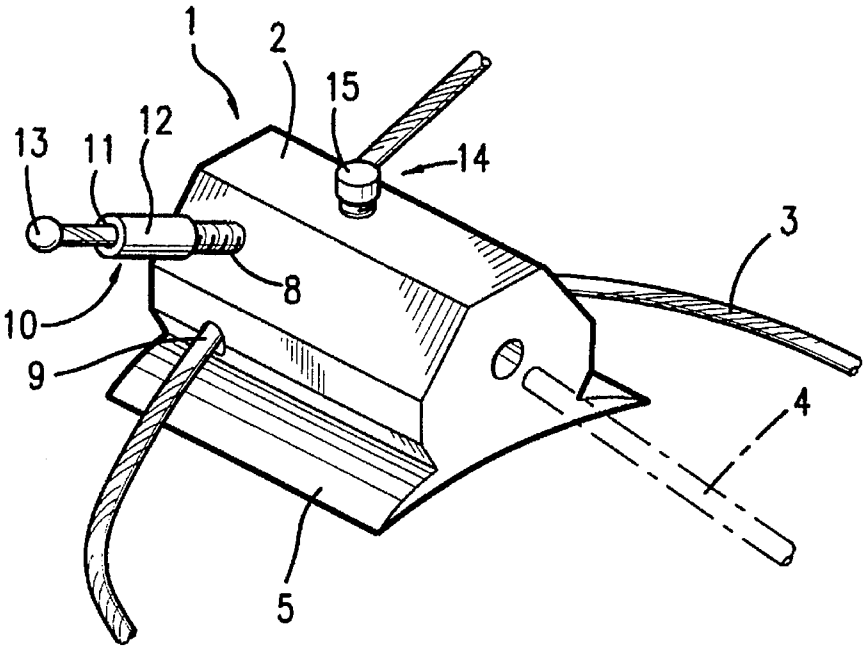
FIG. 1 is a perspective view of the device forming the subject of the invention, in a first embodiment.
Figure 3:
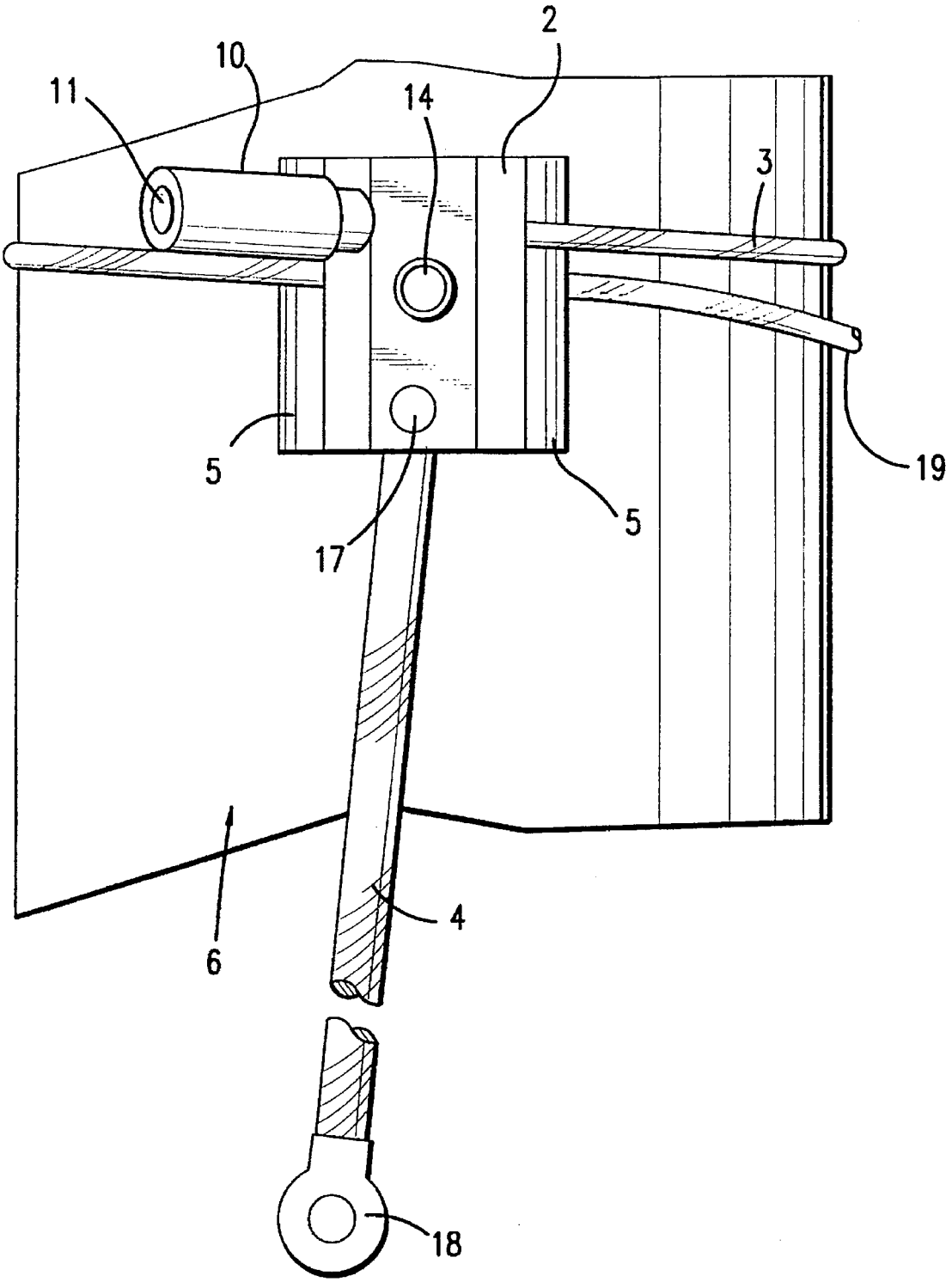
FIG. 3 is a plan view from above, corresponding to FIG. 2.

As shown in FIGS. 1 to 3, relating to a first embodiment of the invention, the device comprises a connector, designated in its entirety by the reference 1, in which may principally be distinguished a rigid body 2 made of electrically conducting material, such as copper alloy, and a flexible filiform conducting element 3 being in the form of a conducting braid or a flexible cablette, for example made of stainless steel. In this first embodiment, the device also comprises a bonding braid 4 connected mechanically and electrically to the rigid body 2 of the connector 1.

The rigid body 2 includes a base 5 of incurvate profile, provided for bearing on a region of the periphery of a cable 6 with a protective shield 7. Provided transversely in the solid part of the body 2 are a tapped hole 8 and a channel 9, both of which pass right through this solid part, in different planes.

Introduced into the tapped hole 8 of the body 2 is a tensioning screw 10 provided with an axial bore 11 and with a shear bead 12. A first end of the cablette 3 passes through the axial bore 11 of the screw 10 and is provided with an enlarged head 13 which bears on an internal retaining shoulder formed in the axial bore 11 of the screw 10.

The flexible cablette 3 is provided for forming, in the position in which the connector 1 is used, a encircling the cable 6, the strand of cablette 3 which forms the end of the loop being inserted through the transverse channel 9 of the body 2. Provided in this body 2 is another tapped hole, emerging in the channel 9 receiving a lock screw 14 with a shear head 15.

The loop formed by the cablette 3 encircling the cable 6 is engaged in a transverse groove, hollowed out in the insulating outer jacket 16 of the cable 6 (in a manner described in detail below) over at least a fraction of its circumference, the bottom of the groove reaching the protective shield 7. Locking the cablette 3 by tightening the screw 14, followed by mechanically tensioning it around the cable 6 by tightening the screw 10, provides the mechanical bonding and electrical contact between the shield 7 forming part of the cable 6 on the one hand, and the cablette 3, and therefore the body 2 of the connector, on the other hand.

The braid 4, which can be made of copper like a bare braid, or coated with an insulation in the manner of a small cable, provides in this case the desired electrical bonding between the connector 1 and an external element, not depicted, such as a grounding system. The first end of the braid 4 is crimped at 17 to the rigid body 2 of the connector 1. The other end, initially free, of the braid 4 is provided with a lug 18 designed to be crimped, screwed, soldered or fixed by any other means to said external element, so as to provide electrical continuity.

By reason of the presence of the bonding braid 4, the free strand 19 of the cablette 3, that is to say the part not forming the loop and located beyond the body 2 of the connector 1, may in this case be cut as clone as possible to the body 2 and removed, as illustrated in FIG. 3.

Figure 4:
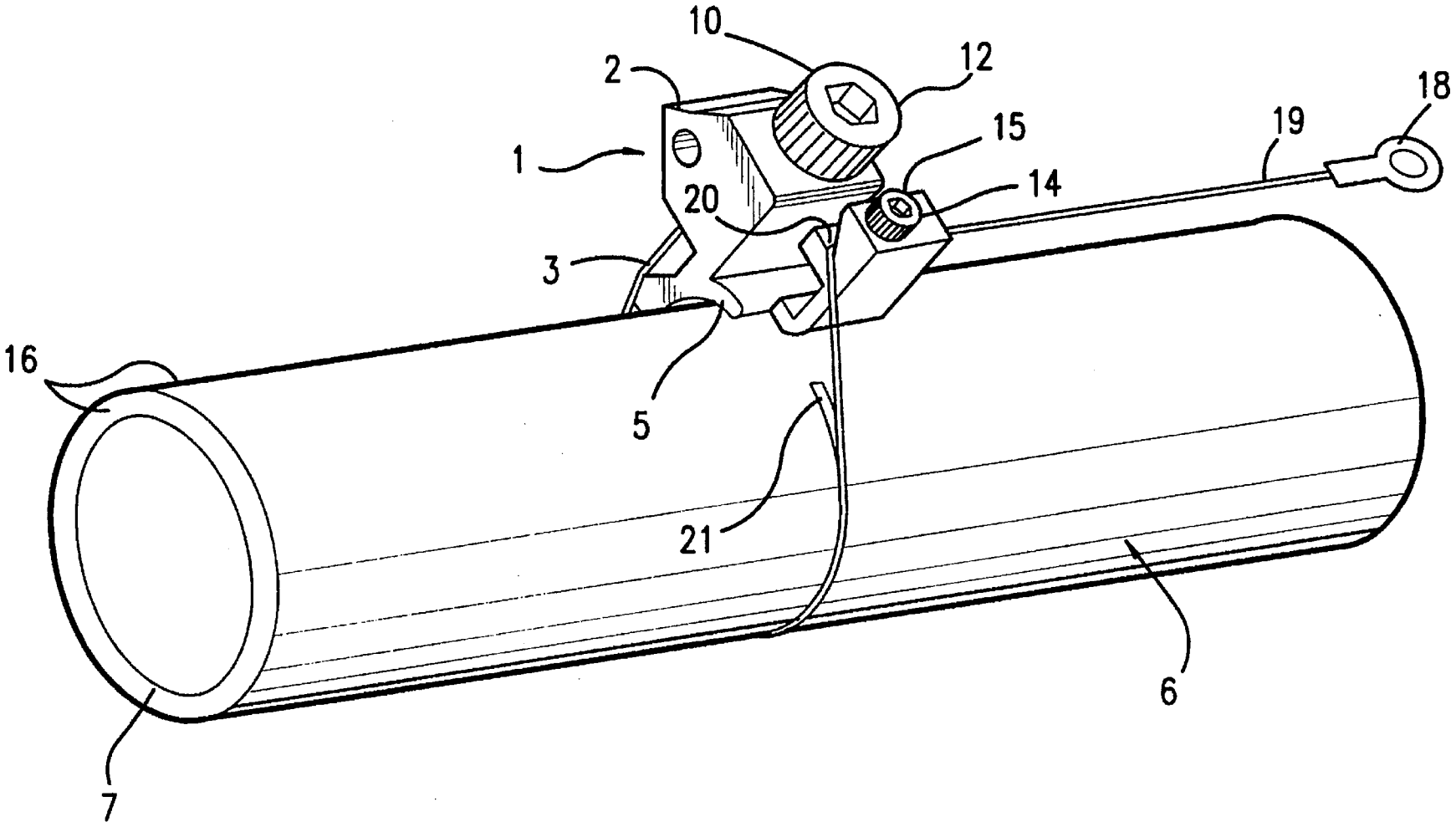
FIG. 4 is a perspective view showing a second embodiment of the connection device according to the invention.
Figure 5:
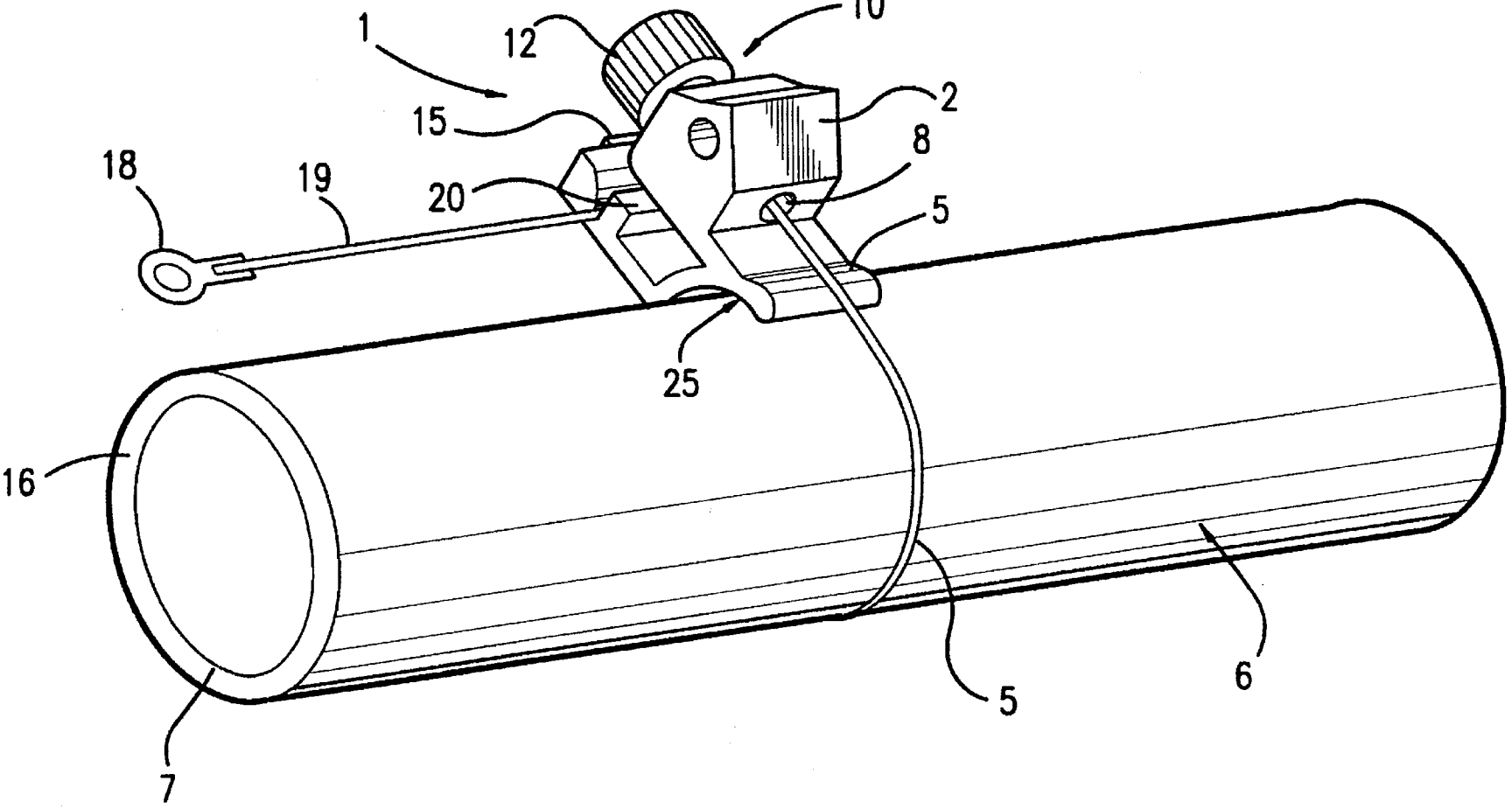
FIG. 5 is another perspective view of the device of FIG. 4.

FIGS. 4 and 5 depict a second embodiment of the invention, in which the rigid body 2 of the connector 1 comprises, in addition to a massive part with a tapped hole receiving the screw 10 for tensioning the cablette 3, a foot in which a notch 20 is provided. A tapped hole, emerging in the notch 20, receives a lock screw 14 with a shear head 15, having an axis parallel to the tensioning screw 10 and located in the same transverse plane.

Thus the cablette 3, forming in a transverse plane a loop which encircles the cable 6, possesses a part looked in the notch 20 by the screw 14 and, beyond this part, a free strand 19 which in this case is bent at right angles and brought into a direction parallel to the axis of the cable 6. The free strand 19 of the cablette 3 serves in this case as a bonding element (replacing the braid 4 of the first embodiment). A lug 18, to be crimped or screwed, is provided at the end of the free strand 19 of the cablette 3. As previously, the loop formed by this cablette 3 is engaged in a groove 21, hollowed out in the insulating outer jacket 16 of the cable 6 and reaching the protective shield 7 of the cable 6.

Figure 6:
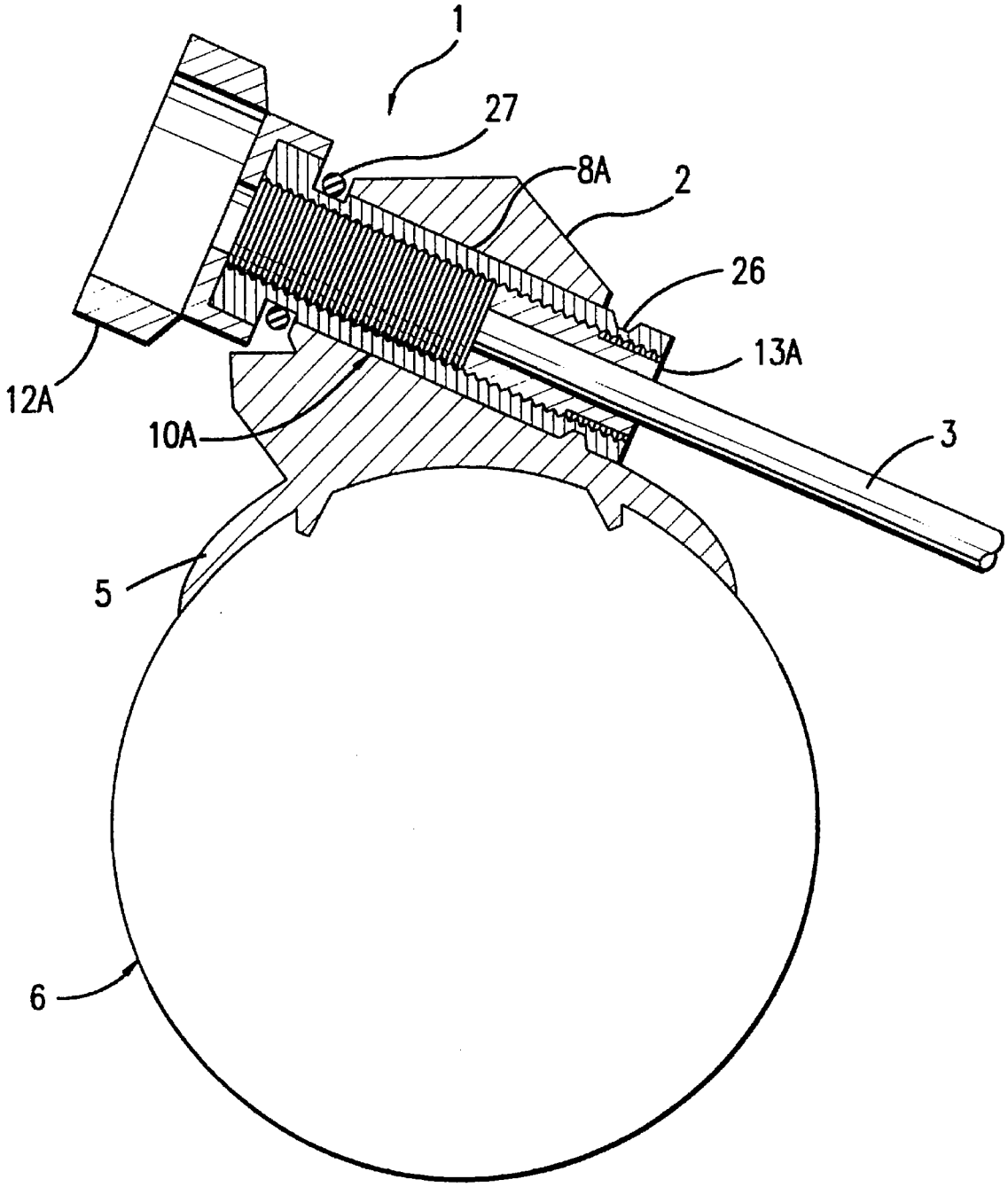
FIGS. 6 and 7 are sectional views of a third embodiment of this connection device, before and after tensioning the flexible conducting element.
Figure 7:
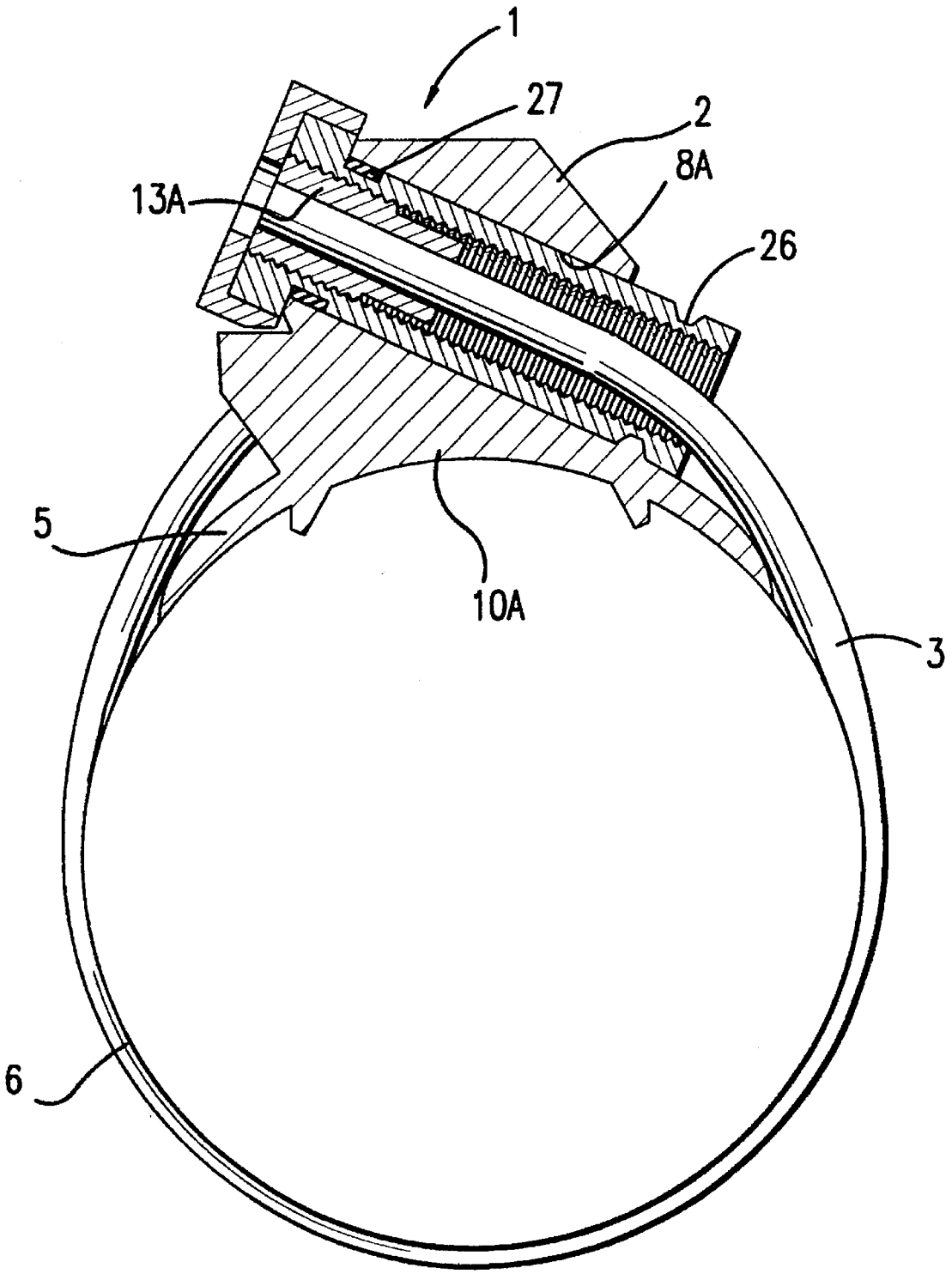

FIGS. 6 and 7 depict a third embodiment, which differs from the previous ones by the construction of the means for the controlled mechanical tensioning of that part of the flexible cablette 3 encircling the cable 6.

The body 2 of the connector 1 includes in this case a smooth hole 8A receiving an externally smooth and internally threaded bush 10A mounted so as to rotate, but axially immobilized on the body 2, the bush 10A including for this purpose an annular groove 26 interacting with a complementary part forming part of the body 2. This bush 10A is provided with a shear operating head 12A allowing controlled technical tensioning.

The end of the cablette 3 is provided with a driver 13*a* made in the form of an externally threaded ring fastened to the end. The driver 13A receives, on the inside, the bush 10A, the external thread of the driver 13A being complementary to the internal thread of the bush 10A.

Before tightening, as shown in FIG. 6, the driver 13A lies towards the end of the bush 10A remote from the operating head 12A. Manual actuation of this operating head 12A, making the bush 10A rotate, causes it to be screwed onto the driver 13A end, consequently, causing the driver 13A to advance in the direction of the operating head 12A, until the desired tightening—see FIG. 7 showing the configuration obtained at the end of the controlled mechanical tensioning of the cablette 3, after which the shear head breaks.

The third embodiment leads to a smaller overall size, the bush 10A not being moved axially with respect to the body 2 and finally only projecting slightly from the body 2. Furthermore, an antivibration O-ring 27 may in this case be mounted and compressed between the operating head 12A of the bush 10A and the entrance of the smooth bole 8A in the body 2.

Figure 8:
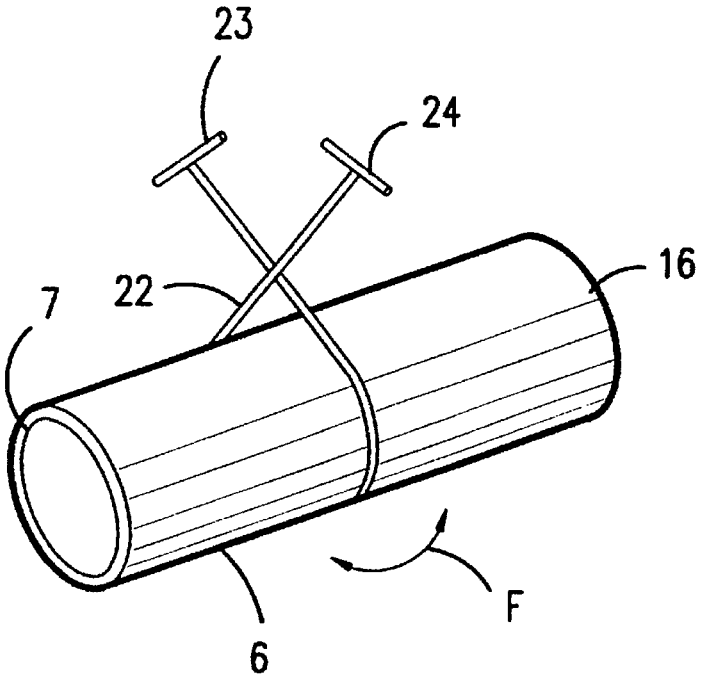
FIGS. 8 and 9 are diagrams illustrating the way of hollowing out the groove on the cable for receiving the connection device.
Figure 9:
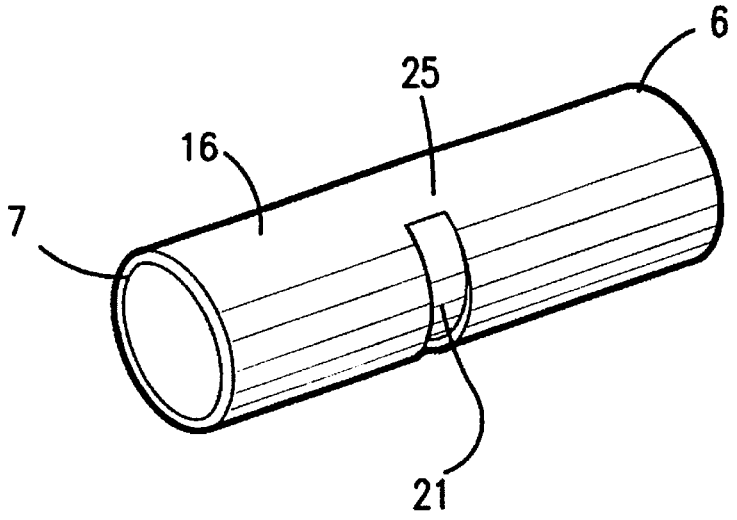

The method of employing the device described above comprises, in a first step, the hollowing-out of the groove 21 in the insulating outer jacket 16 of the cable 6. As illustrated in FIG. 8, this groove 21 can be hollowed out with the aid of an item of equipment constituted by a cord 22, or another filiform flexible member of the same kind, the two ends of which advantageously be equipped with respective gripping handles 23, 24. The cord 22 is brought into position so as to surround the cable 6, the two free strands formed by the end regions of this cord 22 intersecting. The cord 22 is given a to-and-fro movement, as per the arrow F, by the operator gripping this cord, possibly by its two handles 23 and 24. Thus, the cord 22 progressively hollows out, by mechanical and/or thermal effect, in the insulating outer jacket 16 of the cable 6, a groove 21 which extends over an arc less than a complete revolution, covering, for example, approximately 300°, an intact region 25 remaining between the two ends of the groove 21 - see FIG. 9.

Once the groove 21 has been hollowed out, the operator removes the cord 22 and carries out the installation of the connector 1, by applying the body 2 of the connector on the region 25 and by engaging its cablette 3 in the groove 21, in order to form a loop before returning to the body 2 where the cablette 3 is locked by means of the screw 14 with a shear head 15 forming a torque limiter. Next, the controlled mechanical tensioning of the loop on the shield 7 is carried out manually by tightening the screw 10, the shear head 12 of which also acts as a torque limiter.

Then, depending on the case, the electrical bonding with an external element is made, either with the aid of the free strand 19 of the cablette 3 or with the aid of the braid 4.

After immobilization and controlled mechanical tensioning of the cablette 3, engaged in the groove 21, sealing and insulation around both the connector 1 and the cable 6 in the region of the connector may furthermore be provided by various complementary means such as: taping with a self-soldering tape, installation of a fitted shell and filling it with an insulating resin, installation of fitted accessories with flexible parts (for example elastomeric gum), installation of a heat-shrinkable sleeve or of a mechanically shrinkable sleeve.

The connection device in question may be placed on the end of the cable, at a point on a through cable whose ends are inaccessible, around a cable accessible only over a short length, or on a cable accessible only over a small angle. Although the invention is applicable in particular to the connection of shields forming part of telecommunication cables, the connection device in question is also adaptable to cables for transporting electrical power, to video network cables, to coaxial cables, as well as to insulating guides or ducts, it being possible for the construction and geometry of these cables or the like to be multifarious. In particular, the same connection device can be fitted, without modification, to cables of various diameters, forming, together with the cablette, a loop of greater or lesser length encircling the cable.

As goes without saying, and as emerges from the foregoing, the invention is not limited just to the embodiments of this electrical connection device for conducting cable shields which have been described hereinabove by way of examples; on the contrary, it encompasses all the embodiment and application variants of it which satisfy the sense principle. In particular, it would not be outside the scope of the present invention:

- to replace the cablette by any other flexible filiform conducting element, such as a metal tape or strip, able to encircle the cable in the same manner by being engaged in a groove;
- to modify the shape of the body of the connector, as well as the configuration of the means for the securing, immobilizing and controlled mechanical tensioning of said flexible conducting element, it being possible for the tensioning to be performed, for example, by a winder instead of a screw or a threaded busts; or
- to use this connection device for any type of electrical bonding: grounding, connecting to a ground system, continuity, potential equalization, outflow of electromagnetic interference currents.

We claim:

1. An electrical connection device for a protective shield for a conducting cable, the protective shield comprising a metal layer of very small thickness, inserted between an electrical conductor or conductors of the conducting cable and an insulating outer jacket of the conducting cable, the electrical connection device comprises:

- a connector having a rigid body bearing on a region of a periphery of the conducting cable;
- a flexible filiform conducting element provided for encircling the conducting cable positioned in a transverse groove, the transverse groove hollowed out in the insulating outer jacket of the conducting cable, over at least a fraction of a circumference of the conducting cable, and reaching the metal layer; and means for securing an end of the flexible filiform conducting element to the body of the connector and for immobilizing, with controlled mechanical tensioning, of a part of the flexible filiform conducting element encircling the conducting cable.

2. The electrical connection device as claimed in claim 1, wherein the flexible filiform conducting element is made in the form of a conducting braid or of a flexible cablette.

3. The electrical connection device as claimed in claim 1, wherein the flexible filiform conducting element in made in the form of a strip.

4. The electrical connection device as claimed in claim 1, wherein a first end of the flexible filiform conducting element is secured to the body of the connector by means of a threaded controlled-mechanical-tensioning member through which the first end passes axially, the body of the connector including a recess, such as a channel or notch, receiving a strand of the flexible filiform conducting element, forming an end of a loop encircling the conducting cable, a lock screw being provided for immobilizing the strand of the flexible filiform conducting element in the recess.

5. The electrical connection device as claimed in claim 4, wherein the threaded controlled-mechanical-tensioning member is an internally threaded bush mounted so as to rotate, but axially immobilized on the body of the connector, while the first end of the flexible filiform conducting element is provided with an externally threaded driver interacting with the internal thread of the bush.

6. The electrical connection device as claimed in claim 4, wherein the threaded controlled mechanical-tensioning member and the lock screw are screws or bushes with a shear head permitting control of their tightening torque, and therefore control of the contact force of said flexible filiform conducting element on the shield.

7. The electrical connection device as claimed in claim 1, wherein the connector is provided with a conducting braid, one end of which is fastened to the body of the connector and which provides means for grounding of the protective shield of the cable.

8. The electrical connection device as claimed in claim 7 wherein a free end of the strand of the flexible filiform conducting element is used to provide the means for grounding the shield of the cable.

9. The electrical connection device as claimed in claim 8, wherein the free end of the bonding braid of the flexible filiform conducting element is equipped with a lug.

10. The electrical connection device as claimed in claim 1, further comprises, sealing and insulation means for surrounding the connector as well as the cable.

11. A method of making an electrical connection for conducting cable shields by employing the connection device as claimed in claim 1, which essentially comprises the steps of:

hollowing out, in the insulating outer jacket of the conducting cable, over at least a fraction of the circumference of the conducting cable, a groove having a bottom surface defined by the metal layer of the protective shield;

engaging the flexible filiform conducting element in the grove and forming a loop, while the body of the connector is applied on a region of the periphery of the cable;

immobilizing and mechanically tensioning, in a controlled manner, the flexible filiform conducting element; and making the envisaged electrical connection between the connector and an external element.

12. The method of making an electrical connection as claimed in claim 11, wherein the groove is made over a fraction of the circumference of the conducting cable, so as to leave a part of the outer jacket intact, on which part the body of the connector is applied.

13. The method of making an electrical connection as claimed in claim 12, wherein the groove is made in the form of a circular arc of approximately 300°.

14. The method of making an electrical connection as claimed in claim 11, wherein the groove is hollowed out in the insulating outer jacket of the conducting cable by using a filiform flexible element placed around the conducting cable and subjected to a to-and-fro movement thereby forming the groove by a mechanical effect and/or by a thermal effect.

15. The method of making an electrical connection as claimed in claim 1, wherein, after immobilizing and mechanically tensioning the flexible filiform conducting element engaged in the groove, sealing and insulation around the connector as well as the cable are also provided.

16. An item of equipment for implementing the method of making an electrical connection for conducting cable shields as claimed in claim 11, which comprises, for hollowing out the groove in the insulating outer jacket of the conducting cable, the filiform flexible element having two ends, the two ends are equipped with gripping handles enabling the filiform flexible element, when placed around the conducting cable, to be given a to-and-fro movement.

* * * * *